US005383831A

United States Patent [19]

Drath

[11] Patent Number: 5,383,831

[45] Date of Patent: Jan. 24, 1995

[54] GLUTEAL MUSCLE EXERCISE APPARATUS

[76] Inventor: Thomas W. Drath, 410 Grace, Richardson, Tex. 75081

[21] Appl. No.: 891,290

[22] Filed: May 29, 1992

[51] Int. Cl.[6] ..... A63B 21/062

[52] U.S. Cl. ..... 482/101; 482/96; 482/98; 482/142; 482/145

[58] Field of Search ..... 482/94, 98, 99, 101, 482/142, 145, 95, 96, 135

[56] References Cited

U.S. PATENT DOCUMENTS

| | | | |
|---|---|---|---|
| 2,783,045 | 2/1957 | Bosch | 482/96 |
| 3,866,914 | 2/1975 | Jackson | 482/98 |
| 4,316,608 | 2/1982 | Lungberg | 482/94 |
| 4,333,644 | 6/1982 | Lambert, Jr. et al. | 482/101 |
| 4,915,378 | 4/1990 | Abrahamian et al. | 482/99 |
| 5,056,777 | 10/1991 | Capjon et al. | 482/101 |
| 5,070,863 | 12/1991 | McArthur et al. | 482/142 |
| 5,169,363 | 12/1992 | Campanaro et al. | 482/142 |

FOREIGN PATENT DOCUMENTS

| | | | |
|---|---|---|---|
| 3529895 | 2/1987 | Germany | 482/101 |

*Primary Examiner*—Richard J. Apley
*Assistant Examiner*—Lynne A. Reichard
*Attorney, Agent, or Firm*—Johnson & Wortley

[57] ABSTRACT

An exercise apparatus for strengthening and toning gluteal muscles of an exerciser includes structure for supporting the exerciser with his feet fixedly elevated over the remainder of his body, linearly moveable structure for directing movement of the upper portion of the exerciser's body as he pushes that portion of his body out-and-away from his fixedly positioned feet, and structure for varying the resistance presented by the linearly moveable structure to the out-and-away movement made by the exerciser.

18 Claims, 4 Drawing Sheets

GLUTEAL MUSCLE EXERCISE APPARATUS

BACKGROUND OF THE INVENTION

1. Field of the Invention

The present invention relates to exercise machines. More particularly, the present invention relates to exercise machines designed to shape and strengthen the gluteal and hamstring muscles.

2. Description of the Related Art

Human gluteal muscles perform a variety of important functions, the most noteworthy being hip joint movement. Although the importance of strong gluteal muscles to athletes, including serious bodybuilders and runners and the like, is self-evident, strong gluteal muscles are important for virtually everyone. So that one may fully understand the foregoing, as well as the advantages of the present invention, set forth below in this section is a detailed description of the anatomy and the kinesiology of, and prior art exercises for, the gluteal muscles.

With respect to anatomy, the gluteal region, or "buttocks", comprises the posterior muscles on each side of the human hip. The muscles of the gluteal region responsible for hip extension and hyperextension include the well-known gluteus maximus, as well as a number of other, smaller, muscles: the gluteus medius, the gluteus minimis, the six deep outward rotators, and the hamstrings. These muscles are discussed briefly and generally below.

The gluteus maximus is generally the heaviest and largest muscle in the human body. The gluteus maximus is also generally formed of the largest size of muscle fibers found in the body. Thus, almost always, the gluteus maximus is the single strongest muscle in anyone's body. The gluteus maximus forms a quadrilateral pad over the protruding bones of the pelvis. It originates at the dorsal surfaces of the ilium bone of the hip and at the sacral bone of the vertebral column, and it inserts along a tract of fibers running down the lateral portion of the thigh. It also inserts into the proximal portion of the femur (or "thigh bone").

Beneath the gluteus maximus are, in increasing order of depth, the gluteus medius and the gluteus minimis muscles. Both the gluteus medius and gluteus minimis muscles are "fan-shaped". The gluteus medius originates at the ilium of the hip and inserts into a large bump (the "greater trochanter") on the proximal end of the femur. The gluteus minimis originates at a small area on the surface of the ilium, and it, like the gluteus medius, inserts onto the greater trochanter.

The piriformis muscle originates at the sacrum and inserts on the greater trochanter. In addition to its importance in movement, discussed below, this muscle is also important because it lies on top of and protects the sciatic nerve where that nerve exits the dorsal surface of the pelvis. Injury to the sciatic nerve can cause loss of ability to contract almost every muscle in the lower leg as well as most of the hamstring muscles.

The obturator internus muscle originates at the pelvic surface and, after exiting the pelvis, inserts on the medial surface of the greater trochanter. The obturator internus muscle comprises two parts, actually separate muscles, called the superior and inferior gemelli.

The quadratus femoris muscle is a flat, short muscle that lies beneath the obturator and gemelli muscles. The quadratus femoris muscle originates on the protruding bone of the pelvis over which the gluteus maximus lies and it inserts into the femur.

The kinesiology; that is, the principles of mechanics and anatomy in relation to human movement; of the gluteal muscles can be briefly described. While the hamstring is the chief extensor of the thigh, the gluteus maximus muscle is a chief extensor of the thigh against a resistance. Via its attachment to the pelvis, the gluteus maximus can also be a good extensor of the back when the thigh is fixed and the hip joint is free to move (e.g., when rising from a seated position). The gluteus maximus also assists in lateral rotation of the thighs. The gluteus medius and gluteus minimis muscles act to abduct (i.e., move away from the center of the body) the thigh at the hip and to medially rotate the thigh at the hip.

Heretofore, a number of exercises and exercise apparatus have been developed to, at least in part, exercise the gluteal and hamstring muscles. Broadly, these can be broken down into free weight exercises and machine exercises. A number of these exercises and exercise apparatus are discussed below.

One of the free weight exercises (that is, exercises that use dumbbells and barbells as opposed to machines) is the straight-legged dead lift. This exercise works the lower back and hamstrings as well as other gluteal muscles. The straight-legged dead lift involves picking up a bar by bending over, grasping the bar, and slowly lifting it by extending both the back and the knees. As the knees approach a full extension, the exerciser should continue to extend the lower back until he is standing in an erect position. The exerciser then can complete this lift by lowering the weight back to the floor by bending at the waist but not at the knees. This exercise involves the erector spinal, three transverospinal, and hamstring muscles as well as the gluteus maximus muscles. If this exercise is done incorrectly, by, for example, bending the knees during the descent portion of the exercise, the gluteus maximus muscle is not fully stretched and the amount of its development is not optimized.

A second free weight exercise heretofore used to develop the gluteal muscles is the full squat. This exercise begins with a barbell placed across an exerciser's shoulders with the exerciser's feet about shoulder width apart. With his head up and his back straight, the exerciser should then slowly bend his knees until the top of his thighs are 90° or parallel with the floor. Without bouncing from this position the exerciser should raise to a position just short of locking out his knees, and then he should return to the deep squat position. The full squat is like the dead lift insofar as that it is easy to do in a way that does not maximize gluteal stimulation. For example, if the squat is terminated before the thighs become parallel to the floor, the thighs and not the hip extensors are more strongly activated. Also, it is very easy to perform the full squat in a dangerous manner or the exercise may even be inherently dangerous for some people. For example, persons with short torsos often find that their hips and buttocks raise before their back when attempting to stand up from a deep squat. This can put great stress on the lower back. Accordingly, it is fairly common knowledge among weight lifters that if one has a short torso he should not go extremely heavy in this exercise, or lower back injury may result.

Yet another free weight exercise is the lunge, wherein an exerciser essentially steps deeply forward and then springs back into a standing position while carrying a weight across his or her shoulders. Like the squat, the lunge can put undue stress on the exerciser's lower back. Changing weights is also relatively difficult when performing this exercise.

With respect to exercise machines, a number of companies have developed and market gluteal machines. The Nautilus Company, for example, as well as the Marcy Company and a few others, produce hip and back machines that do produce some toning of the gluteal muscles. However, these machines are not nearly as effective as even the deadlift and squat for developing gluteal strength, power and endurance. Certain inward and outer thigh adductor/abductor machines, including ones manufactured by the Marcy and Paramount companies, are fairly effective in isolating and developing the gluteus medius and the gluteal minimis. The outward movement (hip abduction with outward rotation) is designed to work the gluteus medius and gluteus minimus. Some gyms are also now equipped with a standing thigh extension unit or hip and buttocks machine. With these machines the exerciser holds a bar and extends the thigh and leg (with the knee straightened) directly to the rear as far as possible. It is also possible with some of these machines to move the leg to the front of the body, thereby flexing the thigh. Other machines, "Butt Busters" and the like, require an exerciser to lie on his or her side, and then allow only one side or the other of the gluteal region to be exercised at one time. In using many of these machines it is difficult to ensure rotation is from the hip and not the knee. It is also easy to pull the leg to the side, rather than directly backward, which does not work the gluteus maximus muscle as strongly. Also, these machines can be dangerous in that arching of the lower back during extension of the thigh can create or aggravate lower back injuries.

Based upon the foregoing, it should be clear that the heretofore developed exercises and exercise machines designed to strengthen and tone the gluteal muscles all have a number of shortcomings and differences. They all have one or more of the following defects: they do not effectively isolate the target muscles; they do not effectively stress the target muscles; they are potentially dangerous insofar as they may easily cause injuries in use; and they are relatively ineffective insofar as it is easy to use them incorrectly. Thus, it should be appreciated that there is a great need, unfulfilled by the prior art, for a safe, effective, and easy to use gluteal exercise apparatus.

SUMMARY OF THE INVENTION

The present invention overcomes the shortcomings and deficiencies of the prior art by providing an exercise apparatus which isolates, strengthens and shapes gluteal muscles of an exerciser. Embodiments of the present invention include a means for supporting the exerciser with his or her feet fixedly positioned, linearly moveable means for directing movement of the upper portion of the exerciser's body as he or she pushes that portion of his body out-and-away from his or her fixedly positioned feet, and means for increasing the resistance presented by the linearly moveable means to the out-and-away movement made by the exerciser.

Accordingly, it is an object of the present invention to provide an exercise apparatus that effectively isolates an exerciser's gluteal muscles.

It is another object of the present invention to provide an exercise apparatus that effectively stresses an exerciser's gluteal muscles.

Yet another object of the present invention is to provide an exercise apparatus that can be easily used.

Still yet another object of the present invention is to provide an exercise apparatus that is extremely safe.

A further object of the present invention is to provide an exercise apparatus that allows both gluteal muscle groups (or glutes) to be worked at the same time.

Still yet a further object of the present invention is to provide an exercise apparatus that provides a good gluteal "pump" (i.e., flush with blood) because, in part, it involves a compound exercise movement.

Yet another object of the present invention is to provide an exercise apparatus that requires an exerciser to perform a pressing movement, rather than a curling or other such rotating movement.

BRIEF DESCRIPTION OF THE DRAWINGS

Other objects, advantages, and novel features of the present invention will become apparent based upon the following detailed description of the invention when taken in conjunction with the accompanying drawings wherein.

DETAILED DESCRIPTION OF THE INVENTION

Figure 1:
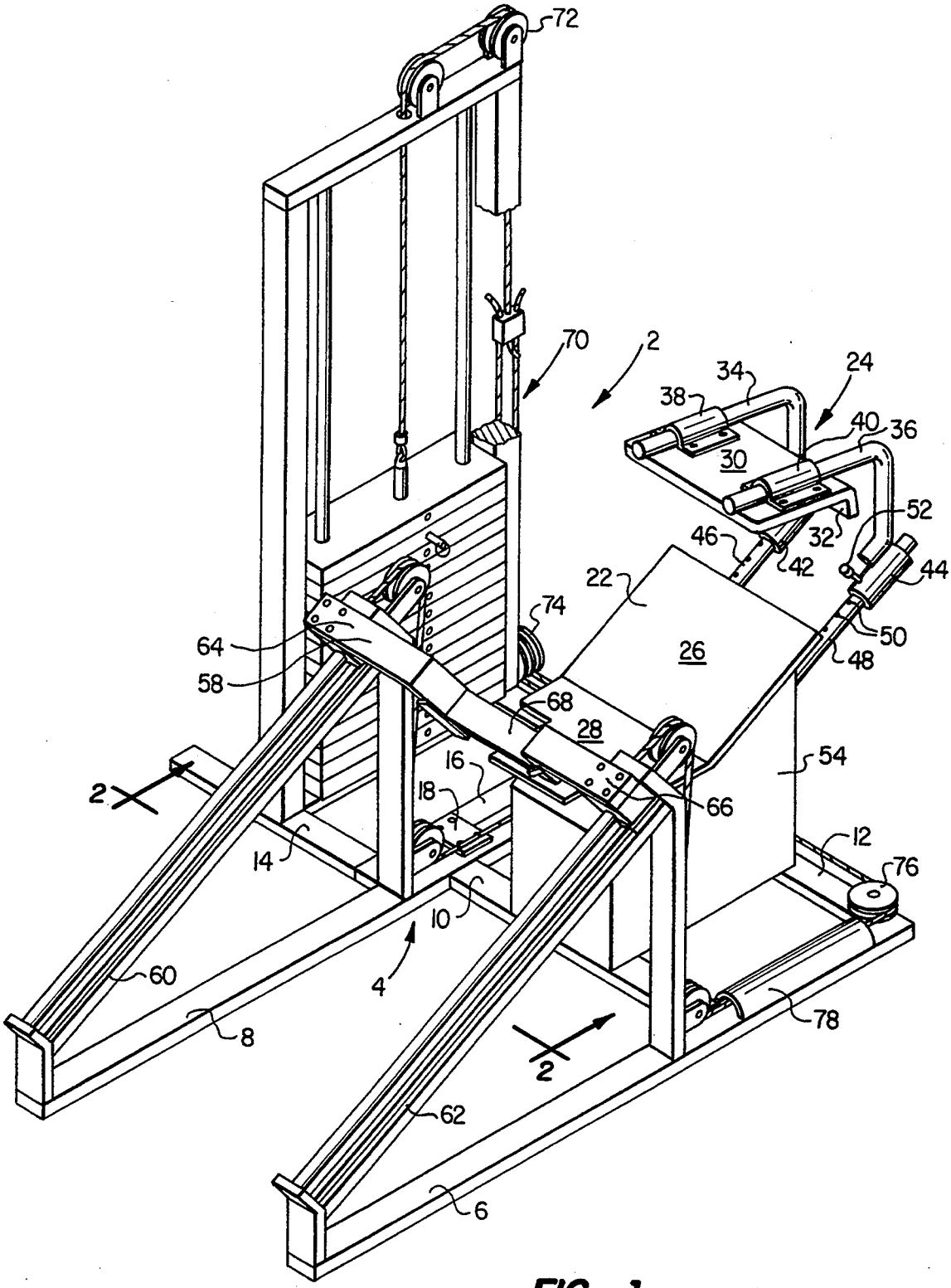
FIG. 1 is a perspective view of an exercise apparatus according to the teachings of the present invention.

Referring now to the drawings wherein identical reference numerals are used to identify like or similar elements throughout the several views, and wherein elements are not necessarily shown drawn to scale, and more particularly to FIG. 1, there is shown an exercise apparatus according to the teachings of the present invention. This exercise apparatus is generally referred to in FIG. 1 by reference numeral 2.

Figures 2, 3:
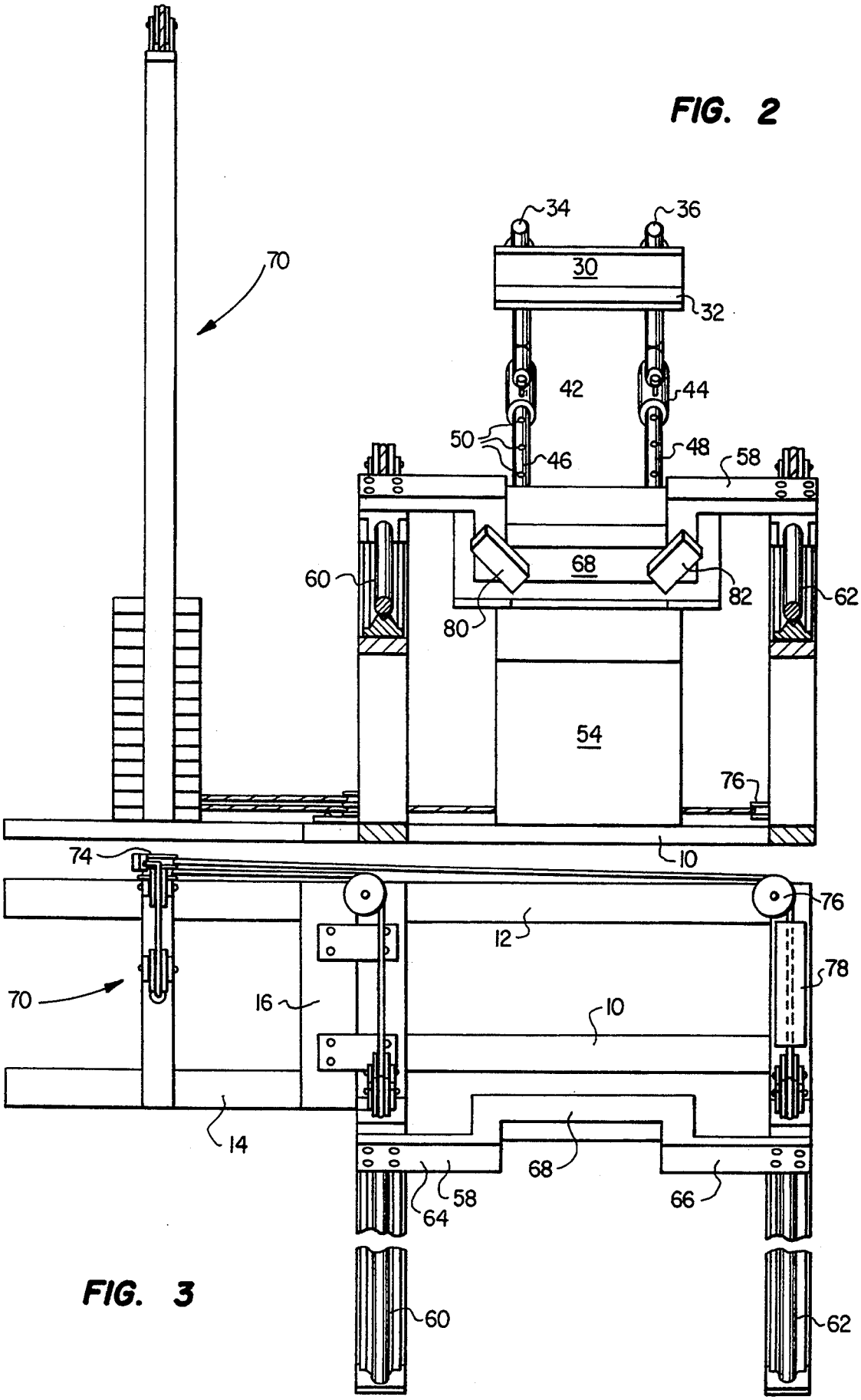
FIG. 2 is a cross-sectional view of the apparatus of FIG. 1 taken along line 2—2.
FIG. 3 is a top view of the apparatus of FIG. 1, partially cut, and with upper exerciser support structure eliminated.

Exercise apparatus 2 rests upon a base, which base is generally designated by reference numeral 4. The base 4 shown in FIG. 1 may be seen to comprise two parallel side beams 6, 8 and two transverse beams 10, 12 interconnecting the two parallel side beams 6, 8. The base 4 shown in FIG. 1 may be seen to also comprise an "I"-shaped structure 14 and structure (including plates 16, 18, 20, best seen in FIG. 3) for interconnecting the structure 14 to the parallel side beam 8. In general, the structure 14 portion of the base 4 acts to support a weight stack structure (discussed further below). The base 4 shown in FIG. 1 is constructed of metal beams, plates, and other structure that has been welded together or otherwise conventionally connected shown. Of course, the base 4 in embodiments of the present invention may have any one of a number of different configurations, and may even be formed, completely or in part, of some material other than metal. The function of the base 4 is to support the exercise apparatus with and without an exerciser using it, and to keep various portions of the exercise apparatus rigidly in place. Any manner of structure that can perform those functions is suitable to be employed in an embodiment of the present invention and should be understood to be encompassed within the "base" element as broadly claimed in the appended claims.

The exercise apparatus 2 also comprises a means for supporting an exerciser with his feet fixedly positioned. In the embodiment shown in FIG. 1 this means includes a bent platform 22 and a foot support platform structure generally designated by reference numeral 24. The bent platform 22 has an inclined portion 26 and a flat portion 28. The foot support platform structure 24 includes a platform 30 with a lip 32, and two bars 34, 36 to which said platform 30 is fixedly connected by conventional connecting means 38, 40. The two bars are also fixedly connected to two sleeves 42, 44 which ride on two other bars 46, 48. In FIG. 1, the bars 46, 48 may be seen to have a series of holes 50 drilled therein and the two sleeves 42, 44 have retractable pins 52 (only one of which can be seen in FIG. 1) which pins 42 can be spring biased to slip into equilevel pairs of the holes 50. The above-mentioned bent platform 22 and foot support platform structure 24 are connected to the base 4 by an intermediate supporting walled structure 54 and other elements disposed within the structure 54. This structure 54 and the other elements function to fixedly support the bent platform 22 and the bars 46, 48. The particular design shown in FIG. 1, which of course is only one of a multitude of possible designs, was chosen for simplicity and aesthetic appeal.

Figure 4A:
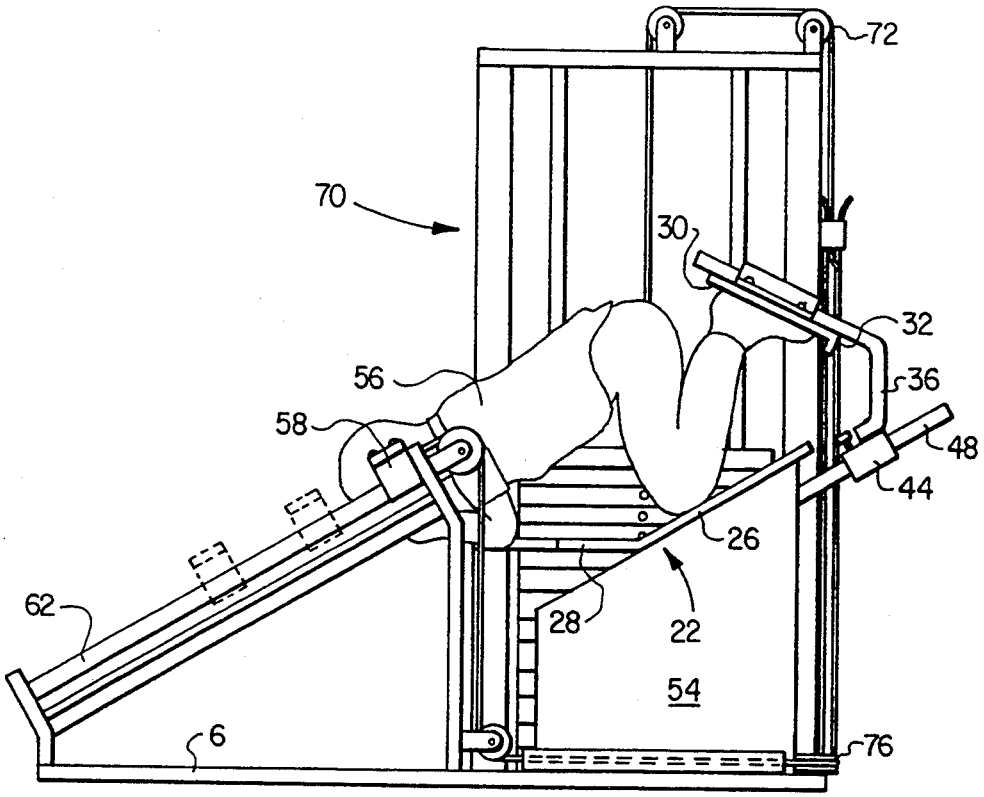
FIG. 4A is a side view of the apparatus of FIG. 1 with an exerciser using the apparatus and with that exerciser being in the starting position.
Figure 4B:
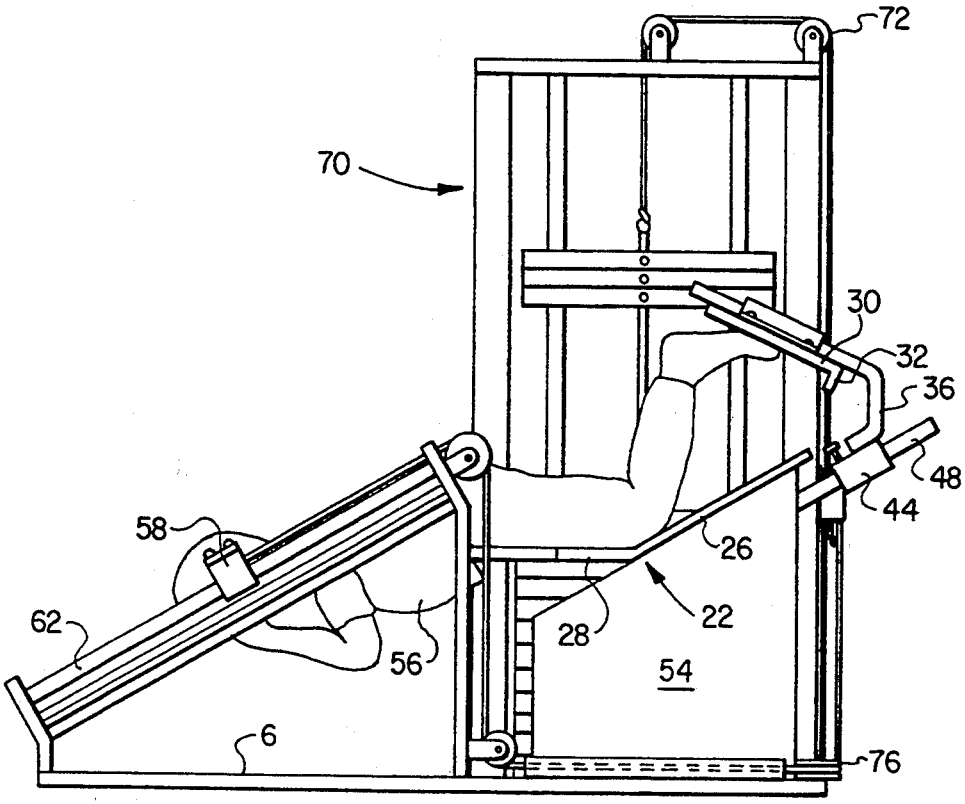
FIG. 4B is a side view of the apparatus of FIG. 1 with an exerciser using the apparatus and with that exerciser being in the extended position.

The operation of the means for supporting an exerciser with his feet fixedly positioned may be best understood with reference to FIGS. 4*a* and 4*b*. FIGS. 4*a* and 4*b* show an exerciser 56 using the exercise apparatus 2. In FIG. 4*a* the exerciser 56 is in a starting position. In FIG. 4*b* the exerciser is in an extended position. These positions, as well as other portions of the present invention that are used by the exerciser 56 will be discussed below. At this point, however, operation of the means for supporting the exerciser can be readily and fully understood. The inclined portion 26 of the bent platform 22 supports the exerciser's knees in both the starting and extended positions. The flat portion 28 of the bent platform 22 supports the exerciser's upper legs and abdomen when the exerciser is in the extended position. The foot support platform 30 is, as may be gathered from its description above, incrementally adjustable. It can and should be adjusted by an exerciser to allow the relative body positionings shown in FIGS. 4*a* and 4*b*. The exerciser's entire foot may and should rest on the platform 30 when in the starting position. The exerciser's toes should just touch the lip 32 of the platform 30 when the exerciser is in the starting position. In the extended position, after an exercise movement that will be described below, the platform 30 serves as a support for the balls of the exerciser's feet.

Yet another element of the embodiment of the present invention shown in FIG. 1 is a linearly moveable means for directing movement of the upper portion of the exerciser's body as he pushes that portion of his body out-and-away from his fixedly positioned feet. Generally, this means comprises a yoke 58 and parallel rails 60, 62 on which the yoke 58 is mounted and on which the yoke 58 may ride.

The yoke 58 has two end portions 64, 66 that are mounted to ride on the rails 60 and 62 in a conventional manner. The yoke also has a depressed intermediate portion 68. The purpose of this depressed intermediate portion is to accommodate the exerciser's head so that his shoulders may rest against the outer end portions 64, 66 of the yoke 58. In a preferred embodiment of the present invention there would be padding (not shown) on those portions of the yoke 58 on which the exerciser's shoulders rest for the exerciser's comfort.

The parallel rails 60, 62 shown in FIG. 1 may be seen to be inclined relative to the base 4. The rails 60, 62 may also be seen to be disposed immediately above beams 8, 6 for stability, are closest to the base 4 at a point distant from the means for supporting the exerciser, and are farthest from the base 4 at a point near the means for supporting the exerciser. Referring again to FIGS. 4*a* and 4*b* this inclination of the parallel rails 60, 62 and the direction this provides to the exerciser using the yoke 58 may be clearly seen. The inclination and direction cause the exerciser 56 to make and out-and-away movement as he pushes the upper portion of his body away from his fixedly positioned feet. The inventors of the present invention have found this out-and-away movement to very effectively isolate and stress the gluteal muscles, so effectively, in fact, that those muscles are readily flushed with blood (i.e., are pumped) by performing this movement so that the muscles are nourished and cleaned. At the same time, this inclination and direction, coupled with the flat portion 28 of the bent platform 22, acts to prevent hyperextension of the exerciser's back, a common cause of injury in many other gluteal targeted exercises.

Still yet another element of the embodiment of the present invention shown in FIG. 1 is a means for varying the resistance presented by the linearly moveable means to the out-and-away movement made by the exerciser. Quite simply, this means comprises a conventional pin selectable weight stack (general designated by reference numeral 70) which is connected via cables and a system of pulleys (e.g., pulleys 72, 74, 76) to the yoke 58. These weights effectively bias the yoke toward the highest part of the rails so that an exerciser 56 must perform intense positive work in moving from the starting to the extended position and so that an exerciser can perform negative work by resisting the pull of the yoke in resuming the starting position after having pushed out-and-away into the extended position.

There are a number of other aspects of the embodiment of the present invention shown in FIG. 1 that are noteworthy. For example, it may be seen that U-shaped plates (e.g., plate 78) are provided to cover cable. They are provided to cause the apparatus 2 to be more aesthetically pleasing than it would be if it had wholly exposed cables. Another aspect that is worthy of note is the double cable system, which is structured so that cables run to both ends of the yoke 58. A double cable system is used in the illustrated embodiment as it offers a more uniform resistance to an exerciser than would a single cable system. Likewise, a two bar foot platform support structure is shown in FIG. 1. A one bar support could, of course, also be used. A two bar system is shown and preferred for increased strength and better stability. Still yet another aspect is best seen with reference to FIG. 2. There it is clearly shown that the yoke 58 is provided with struts 80, 82 for added strength and stability. Struts 80, 82 are, of course, optional elements.

Figure 5:
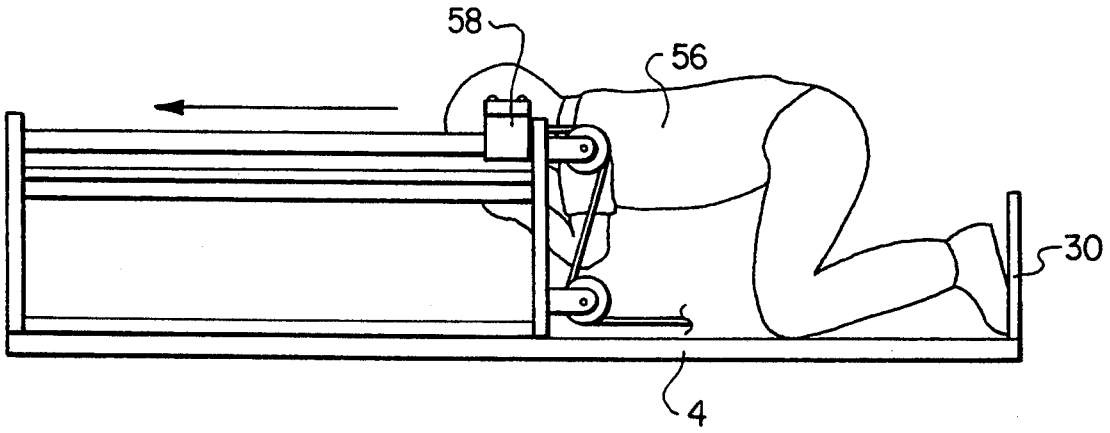
FIG. 5 is a side view of portions of an alternative exercise apparatus according to the teachings of the present invention.
Figure 6:
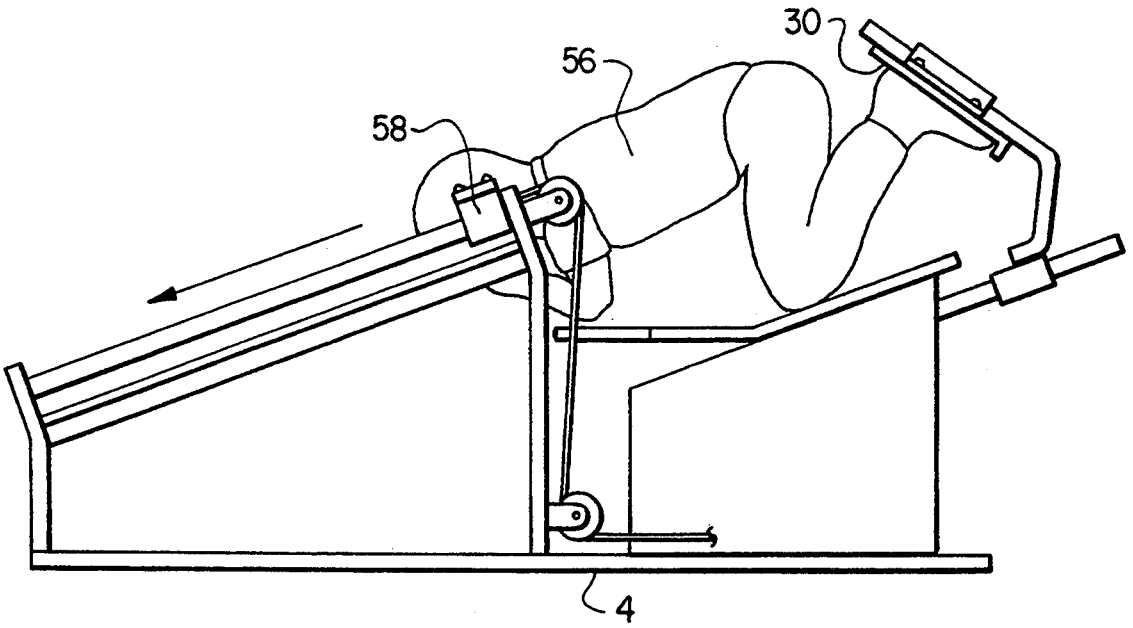
FIG. 6 is a side view of portions of yet another alternative exercise apparatus according to the teachings of the present invention.

Referring now to FIGS. 5 and 6, there are shown two alternative embodiments of the exercise apparatus according to the teachings of the present invention. Both comprise bases 4, foot support platforms 30, and rail mounted biased yokes 58. The embodiment of FIG. 5 is somewhat unique insofar as the base 4 also serves as a knee support platform. With both embodiments, however, the exerciser is caused to perform the out-and-away movement described hereinabove, which isolates and stresses the exerciser's gluteal muscles during exercise performance. FIGS. 5 and 6 highlight the fact that a multitude of angles of directed yoke movement may be employed in embodiments of the present invention. The angle may be about 0° as in FIG. 5, about 20° as in FIG. 6, or about 30° as in FIGS. 1–4. The angle may also be even higher than 30° or it may be any intermediate value of those mentioned above. The inventors the present invention have found an angle of about 30° to be ideal for isolating and stressing the gluteal muscles; virtually any angle, however, should be understood to be encompassed within the scope of the appended claims.

Those skilled in the art should now fully understand and appreciate the structure and operation of the present invention. An exercise apparatus according to the teachings of the present invention causes an exerciser to perform an out-and-away movement that very effectively isolates and stresses the exerciser's gluteal muscles. The preferred embodiment of the present invention disclosed herein has an angular relationship of elements that has been found to quickly and readily pump the exerciser's gluteal muscles. The exercise apparatus according to the teachings of the present invention is believed to designed to help avoid hyperextension of the exerciser's back and/or excessive stress on untargeted muscles.

Obviously, numerous modifications and variations of the present invention may be made in light of the teachings above. For example, only a single cable need be employed in embodiments of the present invention. As another example, the base support structure can be configured a multitude of ways other than as specifically depicted herein, especially if only a single cable is employed, rather than two cables as specifically depicted. Accordingly, within the scope of the appended claims the present invention may be practiced otherwise than as specifically described herein.

What is claimed is:

1. An exercise apparatus for strengthening and toning the gluteal muscles of an exerciser, said exercise apparatus comprising:

means for supporting the exerciser with his feet fixedly positioned over his head, including a knee support platform;

linearly moveable means for directing movement of the upper portion of the exerciser's body as he pushes that portion of his body out-and-away from his fixedly positioned feet to an extended position; and means for varying the resistance presented by said linearly moveable means to the out-and-away movement made by the exerciser.

2. An exercise apparatus as recited in claim 1, wherein said knee support platform is included relative to the ground at points of contact with the exerciser's knees.

3. An exercise apparatus as recited in claim 2, wherein said knee support platform includes a level portion against which an exerciser's legs may come to rest when the exerciser is in the extended position.

4. An exercise apparatus as recited in claim 1, wherein said means for supporting said exerciser with his feet fixedly positioned further comprises an elevated, inclined, foot support platform.

5. An exercise apparatus as recited in claim 1, wherein said linearly moveable means for directing movement of the upper portion of the exerciser's body as he pushes that portion of his body out-and-away from his fixedly positioned feet comprises a yoke for the exerciser.

6. An exercise apparatus as recited in claim 5, wherein said yoke is mounted on parallel rails.

7. An exercise apparatus as recited in claim 6, wherein said parallel rails are inclined relative to the ground on which the exercise apparatus is positioned.

8. An exercise apparatus as recited in claim 7, wherein said means for varying the resistance presented by said linearly moveable means to the out-and-away movement made by the exerciser comprises a pin-variable, selectable weight stack.

9. An exercise apparatus for strengthening and toning the gluteal muscles of an exerciser, said exercise apparatus comprising:

means for supporting the exerciser with his feet fixedly positioned;

linearly moveable means for directing movement of the upper portion of the exerciser's body as he pushes that portion of his body out-and-away from his fixedly positioned feet; and means for varying the resistance presented by said linearly moveable means to the out-and-away movement made by the exerciser, wherein said means for supporting the exerciser with his feet fixedly positioned comprises a means for supporting the exerciser with his feet fixedly elevated over the remainder of his body and a knee support board designed to contact the exerciser's knee while the exerciser is using said exercise apparatus.

10. An exercise apparatus comprising:

a base;

an exerciser body positioning portion fixedly connected to said base;

a yoke support portion, said yoke support portion connected to said base so as to incline upwardly from said base at a portion distant from a positioned exerciser to said exerciser positioning portion at a point near said positioned exerciser;

a yoke movably mounted on said yoke support portion;

means for varying the resistance presented by said yoke to movement on said yoke support portion; and an exerciser foot support portion fixedly connected with respect to said base so as to be positioned opposite aid point distant from a positioned exerciser where said yoke support portion inclines from said base, wherein said exerciser positioning portion comprises a support board parallel to said base and designed to contact said exerciser's upper legs when said exerciser is fully extended and pressing against said yoke.

11. An exercise apparatus as recited in claim 10, wherein said exerciser positioning portion further comprises an inclined board designed to contact said exerciser's knees while the exerciser is using said exercise apparatus.

12. An exercise apparatus as recited in claim 10, wherein said yoke support portion is inclined at an angle of from about 25° to about 40°.

13. An exercise apparatus as recited in claim 12, wherein said yoke support is inclined at an angle of about 30°.

14. An exercise apparatus for exercising a gluteal muscle, comprising:

a base;

parallel rails attached at a first end to said base;

a yoke, movably mounted to said parallel rails and including a means for supporting an exerciser's abdomen;

a knee support attached to said base for supporting the exerciser's knee in a relatively fixed location while the exerciser is operating said exercise apparatus; and a platform having a foot placement surface and being attached to said base for supporting an exerciser's foot while the exerciser is operating said exercise apparatus; said platform and said knee support functionally combine to position the exerciser so that the front of the exerciser's abdomen faces said base.

15. The exercise apparatus of claim 14, wherein said platform, said knee support and said yoke functionally combine to support the exerciser so that the exerciser's head is elevationally below the exerciser's feet.

16. The exercise apparatus of claim 14, wherein said knee support includes a bent platform positioned to support the upper legs and abdomen of the exerciser when the exerciser is in an extended position.

17. The exercise apparatus of claim 14, further comprising resistance means for varying a movement resistance of said yoke on said parallel rails.

18. The exercise apparatus of claim 17, wherein said resistance means includes a double cable system for providing uniform movement resistance to a yoke movement.

* * * * *